US012209466B2

(12) United States Patent
Stepchinsky et al.

(10) Patent No.: US 12,209,466 B2
(45) Date of Patent: Jan. 28, 2025

(54) BIASED LUG CARTRIDGE, WEAR BUSHING WITH BIASED LUG CARTRIDGE, AND SYSTEM AND METHOD USING THE SAME

(71) Applicant: Dril-Quip, Inc., Houston, TX (US)

(72) Inventors: John Stepchinsky, Spring, TX (US); Armando Medina, Jr., Houston, TX (US); Todd L. Scaggs, Fulshear, TX (US)

(73) Assignee: Innovex International, Inc., Houston, TX (US)

( * ) Notice: Subject to any disclaimer, the term of this patent is extended or adjusted under 35 U.S.C. 154(b) by 0 days.

(21) Appl. No.: 18/341,904

(22) Filed: Jun. 27, 2023

(65) Prior Publication Data

US 2023/0417111 A1 Dec. 28, 2023

Related U.S. Application Data

(60) Provisional application No. 63/356,417, filed on Jun. 28, 2022.

(51) Int. Cl.

| | |
|---|---|
| ***E21B 17/12*** | (2006.01) |
| ***E21B 7/12*** | (2006.01) |
| ***E21B 17/10*** | (2006.01) |
| ***E21B 23/00*** | (2006.01) |

(52) U.S. Cl.

CPC ..... *E21B 17/1007* (2013.01); *E21B 17/12* (2013.01)

(58) Field of Classification Search

None

See application file for complete search history.

(56) References Cited

U.S. PATENT DOCUMENTS

| | | | | |
|---|---|---|---|---|
| 4,995,458 | A * | 2/1991 | Garbett | E21B 23/00 166/85.3 |
| 5,044,438 | A | 9/1991 | Young | |
| 6,041,859 | A * | 3/2000 | Blades | E21B 33/043 166/208 |
| 6,142,545 | A * | 11/2000 | Penman | E21B 19/00 294/86.15 |
| 6,695,059 | B2 * | 2/2004 | Thomas | E21B 33/035 166/368 |
| 6,749,018 | B1 | 6/2004 | Ford et al. | |
| 7,284,616 | B2 | 10/2007 | Williams et al. | |

(Continued)

OTHER PUBLICATIONS

Notification of transmittal of the international search report and the written opinion of the international searching authority, or the declaration, Application No. PCT/US2023/026302, filed Jun. 27, 2023, mailed Oct. 17, 2023, 13 pages.

*Primary Examiner* — Matthew R Buck
*Assistant Examiner* — Douglas S Wood
(74) *Attorney, Agent, or Firm* — Baker Botts L.L.P.

(57) ABSTRACT

A wear bushing includes: a wear bushing body having one or more cavities formed therein; and one or more lug cartridges each disposed within a corresponding one of the cavities in the wear bushing body. Each lug cartridge includes: a biased lug configured to be transitioned between a first position in which the lug protrudes in a radially inward direction from an inner diameter of the wear bushing body and a second position in which the lug is retracted into the corresponding cavity of the wear bushing body; and a retainer configured to retain the biased lug in the second position.

26 Claims, 13 Drawing Sheets

(56) References Cited

U.S. PATENT DOCUMENTS

| | | | | |
|---|---|---|---|---|
| 7,900,708 | B2 * | 3/2011 | Obrejanu | E21B 23/01 166/216 |
| 9,540,888 | B2 | 1/2017 | Reimert | |
| 10,662,743 | B2 * | 5/2020 | Twardowski | E21B 17/12 |
| 11,072,984 | B2 | 7/2021 | Queiroz et al. | |
| 2002/0092656 | A1 | 7/2002 | Ford et al. | |
| 2003/0042022 | A1 * | 3/2003 | Lauritzen | E21B 33/1295 166/207 |
| 2003/0192704 | A1 | 10/2003 | Ford et al. | |
| 2009/0139724 | A1 * | 6/2009 | Gray | E21B 23/04 166/345 |
| 2010/0175882 | A1 * | 7/2010 | Bailey | E21B 33/085 166/387 |
| 2017/0183922 | A1 | 6/2017 | Nguyen | |
| 2020/0318460 | A1 | 10/2020 | Twardowski et al. | |

* cited by examiner

BIASED LUG CARTRIDGE, WEAR BUSHING WITH BIASED LUG CARTRIDGE, AND SYSTEM AND METHOD USING THE SAME

CROSS REFERENCE TO RELATED APPLICATION

This application is a non-provisional patent application claiming the benefit of U.S. Provisional Application No. 63/356,417, filed on Jun. 28, 2022, which is incorporated by reference in its entirety for all purposes.

TECHNICAL FIELD

The present disclosure relates generally to wear bushings for use in oil and gas wells, and more particularly, to a selectively-retrievable wear bushing equipped with a spring-loaded lug cartridge.

BACKGROUND

Wear bushings (sometimes referred to as "wear sleeves" or "bore protectors") are used while drilling to protect the bore of surface or subsea well equipment from damage or wear. The bore of the wellhead must be protected so that metal-to-metal seal assemblies can later be installed when a casing hanger is landed and the annulus between the wellhead bore and the casing run is "packed-off" with the metal seal assembly. Scratches in the wellhead bore could prevent the metal seal from passing pressure tests.

Certain designs of wear bushings were introduced to enable installation and retrieval of the wear bushings while the drill bit and bottom hole assembly were being run and retrieved. These were called "bit runable wear bushings" and later shortened to "wear sleeves." A drawback of these designs is that every time the bit is retrieved, the wear sleeve is also retrieved. There is risk involved with this process, because the drill bit passes through the exposed wellhead before the wear sleeve is installed and, on the trip out, the wear sleeve is retrieved first, and later the drill bit will pass through the exposed wellhead. In the case of smaller, deeper drilling intervals, the drilled hole may require multiple trips because worn drill bits would have to be replaced before the desired depth of penetration is reached.

Selectively retrievable wear bushings (or wear sleeves) were introduced, allowing the wear bushings to remain installed both as the drill bit and bottom hole assembly are being run and retrieved. This prevents the risk associated with exposure of the wellhead to wear during drilling processes. There is room for improvement in the conventional selectively retrievable wear bushings. For example, these selectively retrievable wear bushings and their associated running tool(s) can be difficult and costly to manufacture. In addition, conventional designs for selectively retrievable wear bushings require the use of a specially constructed adapter coupled to the drill string, regardless of whether the wear bushing is going to be left in the wellhead or retrieved. Finally, conventional designs of selectively retrievable wear bushings and their associated running tools lack flexibility, since each wear bushing size has its own uniquely sized dedicated adapter.

It is now recognized that a need exists for selectively retrievable wear bushings that have a more flexible and/or modular design with improved manufacturability.

SUMMARY

Embodiments of the present disclosure are generally directed to wear bushings (also known as "wear sleeves" or "bore protectors"), and more particularly, to wear bushings for use in oil and gas wells, and more particularly, to a selectively-retrievable wear bushing equipped with a spring-loaded (or otherwise biased) lug cartridge. The systems and methods disclosed herein may be used to allow for efficient replacement of lugs (also referred to as "dogs" or "dog segments") from a wear bushing. In particular, a modular-style lug cartridge may be assembled prior to installation on a wear bushing. The lug cartridge may be capable of being reset on the surface or replaced with a new lug cartridge.

In order to leave the wear bushing in the wellbore, the lug cartridge may be actuated by a running tool. The actuation may collapse one or more spring-loaded lugs and allow the one or more lugs to be retained by a retainer (e.g., spring-loaded or otherwise biased retainer). Thus, the bore of the wear bushing may be exposed so that objects will not catch on the lugs. In order to return the wear bushing to the rig floor, a split lock ring attached to an adapter coupled to the running tool may engage into a mating profile of the wear bushing. In case the lug cartridge needs to be run downhole a second time, the lug cartridge may be equipped with a quick reset. The desired configuration of the selectively retrievable wear bushing may be determined and implemented at the rig floor via minor adjustments.

The present disclosure embodies several advantages. For example, the disclosed wear bushings, adapters, and associated running tools allow for improved manufacturability, since the design uses a reduced length running tool compared to existing systems, no weld-on fins extending from the adapter, and modular lug cartridges that can be used on any size wear bushing. Furthermore, many embodiments of the present disclosure eliminate the need for an adapter when leaving the wear bushing in the wellhead. Additionally, embodiments of the present disclosure eliminate the need for an adapter whenever it is desired for the wear bushing to remain in the wellhead. Moreover, all wear bushings and their associated adapters may have the same top interface, regardless of the size of the wellhead in which the wear bushing is being positioned, making the wear bushing retrievable via a multi-purpose tool (MPT) as opposed to a dedicated retrieval tool. These and other advantages of the systems and methods of the present disclosure may be used to improve bushing-related wellbore processes.

These and other features and characteristics of the disclosed systems and methods will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and the claims, the singular forms of "a", "an", and "the" include plural referents unless the context clearly dictates otherwise.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

For purposes of the description hereinafter, it is to be understood that the disclosure may assume alternative variations and step sequences, except where expressly specified to the contrary. It is also to be understood that the specific devices and processes illustrated in the attached drawings and described in the following specification are simply exemplary aspects of the disclosure. Hence, specific dimensions and other physical characteristics related to the aspects disclosed herein are not to be considered as limiting.

As used herein, the term "coupled" should be understood to include any direct or indirect connection between two things, including, and without limitation, a physical connection (including, and without limitation, a wired or mechanical connection), a non-physical connection (including, and without limitation, a wireless connection), or any combination thereof. Furthermore, the words "comprising" (and any form of comprising, such as "comprise" and "comprises"), "having" (and any form of having, such as "has" and "have"), "including" (and any form of including, such as "includes" and "include") or "containing" (and any form of containing, such as "contains" and "contain") are to be understood as inclusive and open-ended and do not exclude additional, unrecited elements or method steps.

As used herein, the term "at least one of" is synonymous with "one or more of." For example, the phrase "at least one of A, B, and C" means any one of A, B, and C, or any combination of any two or more of A, B, and C. For example, "at least one of A, B, and C" includes one or more of A alone; or one or more of B alone; or one or more of C alone; or one or more of A and one or more of B; or one or more of A and one or more of C; or one or more of B and one or more of C; or one or more of all of A, B, and C. Similarly, as used herein, the term "at least two of" is synonymous with "two or more of." For example, the phrase "at least two of D, E, and F" means any combination of any two or more of D, E, and F. For example, "at least two of D, E, and F" includes one or more of D and one or more of E; or one or more of D and one or more of F; or one or more of E and one or more of F; or one or more of all of D, E, and F.

Figure 1A:
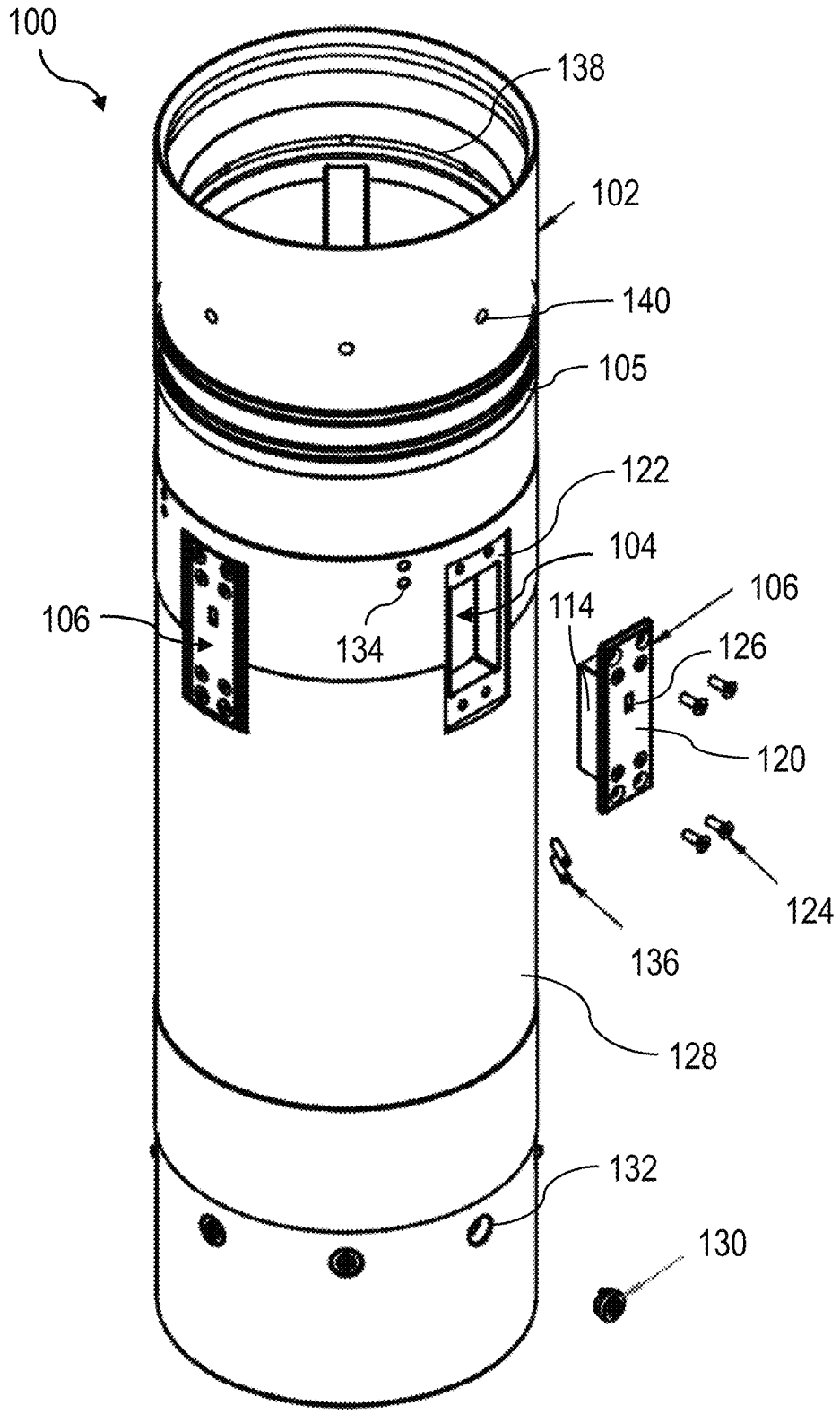
FIGS. 1A and 1B are exploded perspective and cross-sectional views, respectively, of a wear bushing, according to one or more embodiments.
Figure 1B:
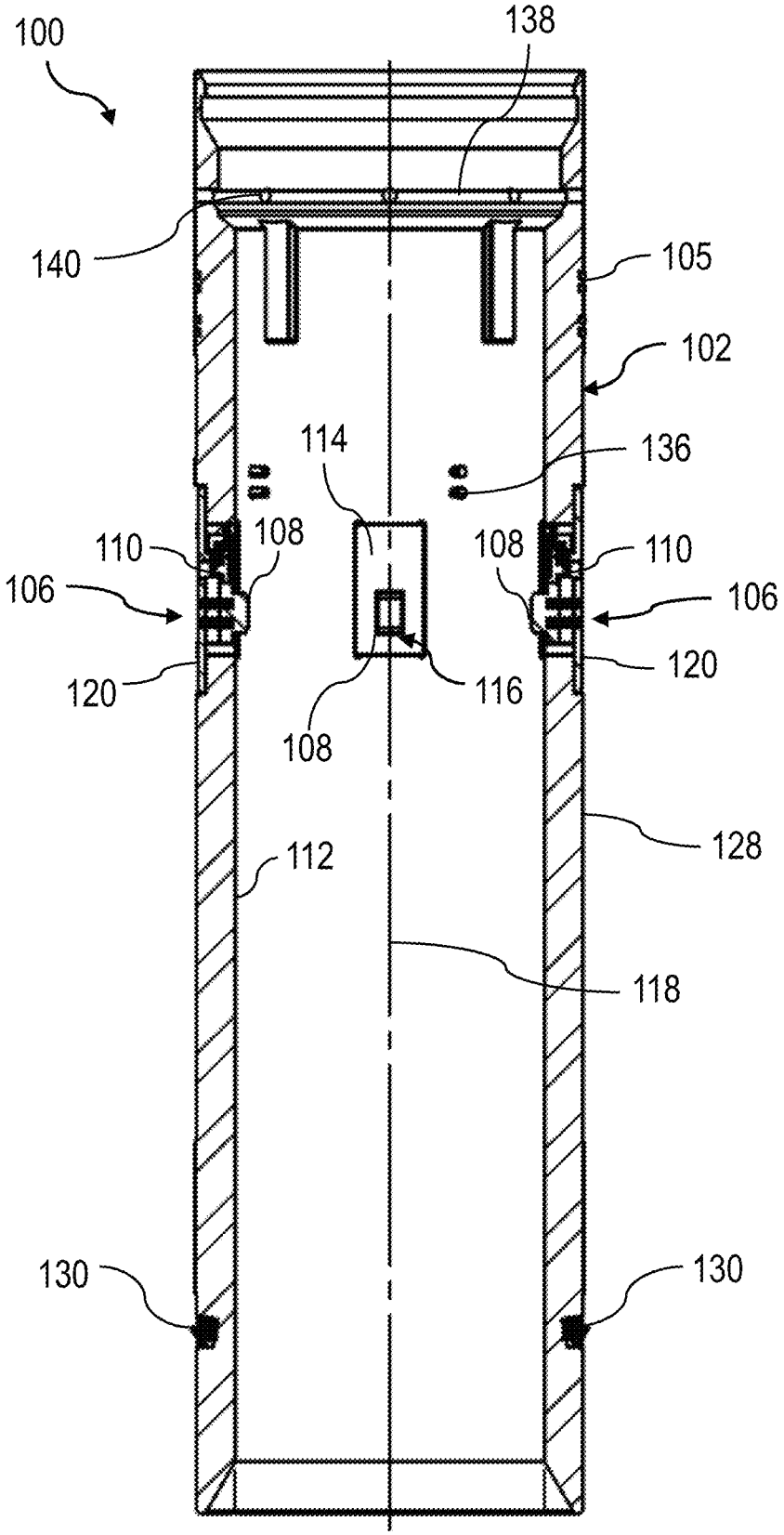

Turning now to the drawings, FIGS. 1A and 1B illustrate a wear bushing 100, in accordance with one or more embodiments of the present disclosure. The wear bushing 100 may be a selectively retrievable wear bushing. The phrase "selectively retrievable" means that the wear bushing 100 may be positioned in a well component (e.g., wellhead) and selectively maintained within the well component during subsequent trips of the drilling string (and running tool) through the well component or selectively retrieved to the surface by the running tool.

The wear bushing 100 includes a wear bushing body 102 having one or more cavities 104, as shown. In the illustrated embodiment, the wear bushing body 102 includes four such cavities 104. However, in other embodiments, the wear bushing body 102 may include a different number (e.g., 1, 2, 3, 5, 6, 7, 8, 9, 10, or more) cavities 104 formed therein. The wear bushing body 102 may be formed of metal and generally cylindrical in shape. The wear bushing body 102 has a bore extending therethrough, and an inner circumferential surface 112 of the bore of the wear bushing body 102 is generally smooth. Indeed, the wear bushing body 102 may be similar in construction to conventional wear bushings used to protect the bores of surface and subsea wellheads. Seals 105 may be disposed around an upper portion of the wear bushing body 102, as shown.

The wear bushing 100 also includes one or more lug cartridges 106. When the wear bushing 100 is fully assembled, each lug cartridge 106 is disposed within a corresponding one of the cavities 104 in the wear bushing body 102. As illustrated, the wear bushing 100 may include multiple lug cartridges 106 disposed in cavities 104 located substantially equidistant from each other about a circumference of the wear bushing body 102.

As shown, the lug cartridges 106 may have generally the same size, shape, and construction as each other, but are each located in a different cavity 104 in the wear bushing body 102. FIG. 1A shows an exploded version of one lug cartridge 106, while FIG. 1B shows cross sections of two lug cartridges 106. Each lug cartridge 106 includes at least a spring-loaded (or otherwise biased) lug 108 and a retainer 110. Although the term "spring-loaded" is used throughout the application, and springs are shown in the drawings, it should be noted that other types of biasing mechanisms may be used to bias the lug(s) 108 and/or the retainer 110 in given directions. For example, instead of spring(s), one or more hydraulic cylinders or other such features may be used to bias the lug 108 (or the retainer 110) in a given direction. The spring-loaded lug 108 is configured to be transitioned between a first position in which the lug 108 protrudes in a radially inward direction from the inner circumferential surface 112 of the bore of the wear bushing body 102 (as shown in FIG. 1B) and a second position in which the lug 108 is retracted into the corresponding cavity 104 of the wear bushing body 102. The retainer 110 is configured to retain the spring-loaded lug 108 in the second (i.e., retracted) position.

Each lug cartridge 106 may further include a housing 114 holding the spring-loaded lug 108 and the retainer 110. The housing 114 has an opening 116 formed therein such that the spring-loaded lug 108, in its first (protruding) position extends outward from the opening 116 of the housing 114. As shown, each lug cartridge 106 may have an elongated shape (e.g., having a length that is greater than a width of the housing 114). The lug cartridges 106 may each be positioned such that a long side of the lug cartridge 106 is substantially (e.g., less than 5 degrees from) parallel to a longitudinal axis 118 of the wear bushing body 102. In addition, the lug cartridge 106 may include a plate 120 (or plate surface of the housing) on a side of the housing 114 opposite the opening 116. The plate 120 may be separate from and coupled to the housing 114, or integral with the rest of the housing 114. The plate 120 may secure the lug cartridge 106 to the wear bushing body 102. In particular, the plate 120 may be used to form a connection between the lug cartridge 106 and the wear bushing body 102. For example, as shown, the plate 120 may be disposed over and coupled to an outer surface (e.g., a recess formed in the outer surface) 122 of the wear bushing body 102 via one or more fastening mechanisms 124 (e.g., bolts (as shown), screws, welds, or others) to secure the lug cartridge 106 to the wear bushing body 102. In other embodiments, the lug cartridge 106 may be secured to the wear bushing body 102 by other mechanisms such as, for example, a snap fit, an interference fit, and/or fastening mechanisms extending laterally from the lug cartridge 106 to engage the wear bushing body 102. The lug cartridges 106 may each be easily removed from the wear bushing body 102 at a desired time and replaced with a new component, for example, if the lug has experienced significant wear during its prior use.

Each lug cartridge 106 may include a reset opening 126 therein that enables access to an inside of the lug cartridge 106 (e.g., inside of the housing 114). As shown, the reset opening 126 may be formed in the plate 120. In other embodiments, the reset opening 126 may be formed in other parts of the lug cartridge 106. The reset opening 126 may be accessible from outside an outer circumferential surface 128 of the wear bushing body 102. This enables for simple resetting of the lug cartridge 106 upon the wear bushing 100 being retrieved to a surface location. Resetting the lug cartridge 106 involves resetting the spring-loaded lug 108 from the second (retracted) position back to the first (extended) position. As described in more detail below, the retainer 110 of each lug cartridge 106 may include an engagement feature configured to interface with a tool received through the reset opening 126 to release the spring-loaded lug 108 from the second position back to the first position. As such, the wear bushing 102 may be retrieved to a surface location, and the spring-loaded lug 108 reset without removing the lug cartridge 106 from the wear bushing body 102.

Further details regarding the possible structure and function of individual lug cartridges 106 are provided below with reference to FIGS. 2A-2E.

In addition to the lug cartridge(s) 106, the wear bushing 100 may include one or more spring-loaded pins 130, which may be spring-loaded shear pin assemblies. The wear bushing body 102 may include a number (e.g., eight) of threaded pockets 132 spaced around the outer circumferential surface 128 of the wear bushing body 102 that are designed to accommodate the spring-loaded pins 130. The spring-loaded pins 130 are designed to interface with an inner circumferential surface of a well component. For example, the spring-loaded pins 130 may be designed to lock into corresponding recesses formed in a casing hanger or a landing shoulder within a wellhead, as will be understood by a person of ordinary skill in the art.

The wear bushing body 102 may include a number (e.g., eight) shear pin holes 134 formed therethrough. The shear pin holes 134 may be designed to accommodate shear components 136 (e.g., shear pins). As illustrated, the shear pin holes 134 may be arranged in pairs, the shear pin holes 134 in each pair being separated in a direction parallel to the longitudinal axis 118. The different pairs of shear pin holes 134 may be spaced around the outer circumferential surface 128 of the wear bushing body 102. However, it should be noted that other arrangements of one or more shear pin holes 134 through the wear bushing body 102 may be used in other embodiments.

The wear bushing body 102 may include a groove 138 formed along the inner circumferential surface 112 of the wear bushing body 102. As described in more detail below, the groove 138 may be configured to receive an expending lock ring from a retrieval adapter used to retrieve the wear bushing 100 from the well component in which it is landed to the surface. As illustrated, the wear bushing body 102 may include a number of pin holes 140 extending through the wear bushing body 102 at circumferentially spaced positions aligned with the groove 138. These pin holes 140 may facilitate the disconnection of the wear bushing 100 from a retrieval adapter. For example, pins or other components may be inserted into these pin holes 140 to radially collapse the lock ring of the retrieval adapter so that the lock ring disengages from the groove 138 of the wear bushing 100.

Although not shown, in some embodiments the multiple lugs 108 positioned circumferentially along the wear bushing body 102 may be connected to each other to enable consistent, uniform, and/or controlled transitioning of the lugs 108 between their first (expanded) positions and their second (retracted) positions. For example, a split ring may be coupled to each of the lugs 108, either along a radially inner surface of the wear bushing body 102 or on a radially outer surface of the wear bushing body 102. If the lugs 108 are connected to a split ring on the outside of the wear bushing body 102, the plates 120 may have openings formed therein to enable a connection point between the lugs 108 and a split ring. In certain embodiments, the multiple lugs 108 may be integral with such a split ring. For example, the lugs 108 may constitute a split ring having multiple, thicker dog segments of the ring with thinner ring segments interspersed between the dog segments.

Figure 2A:
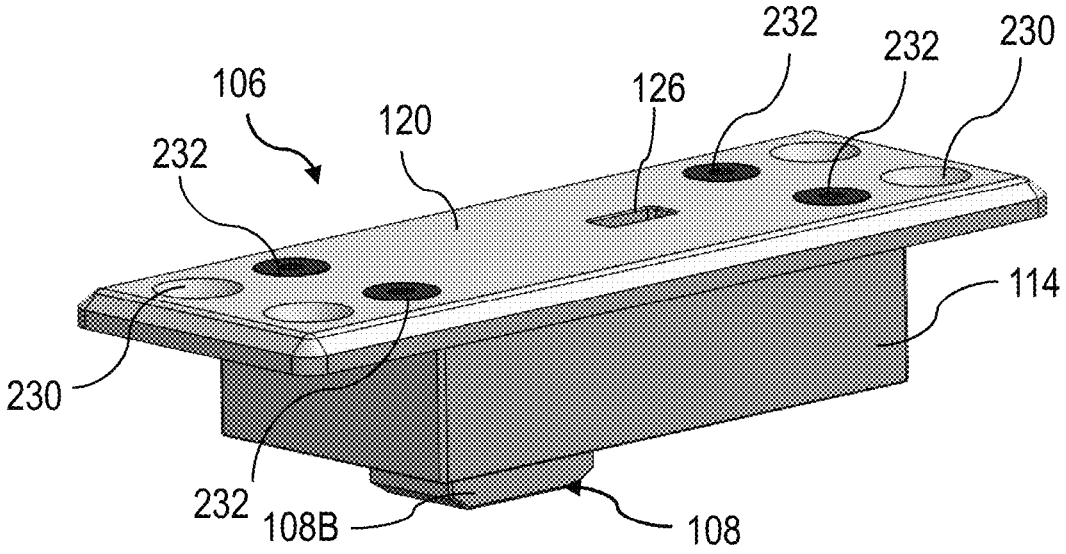
FIGS. 2A-2C are perspective, top, and exploded views, respectively, of a lug cartridge, according to one or more embodiments.
Figure 2B:
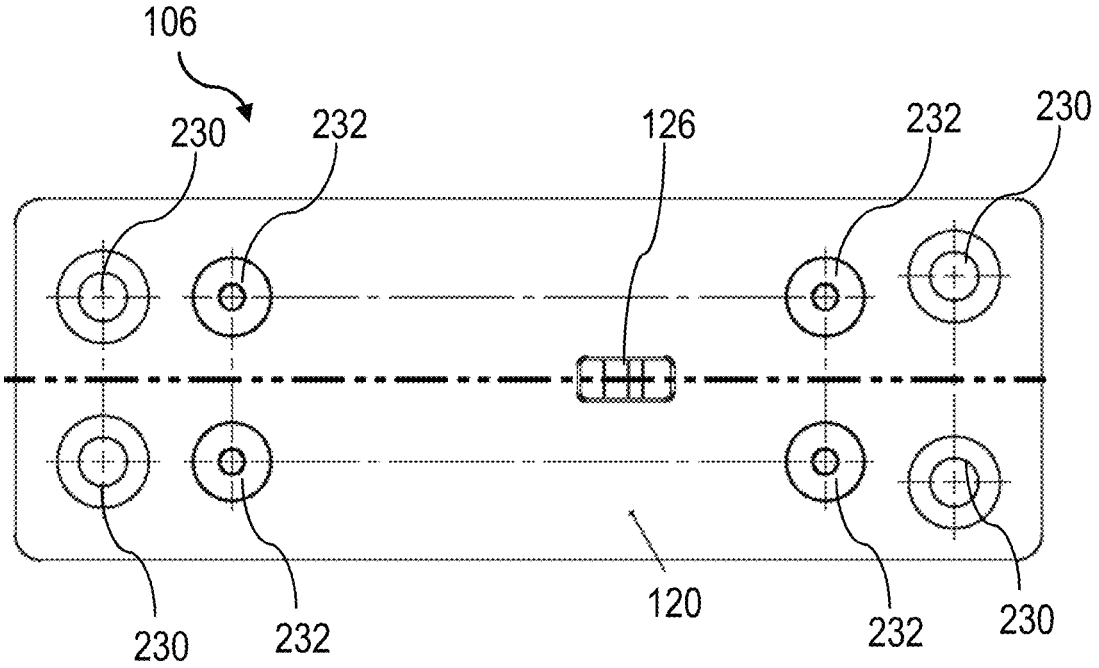
Figure 2C:
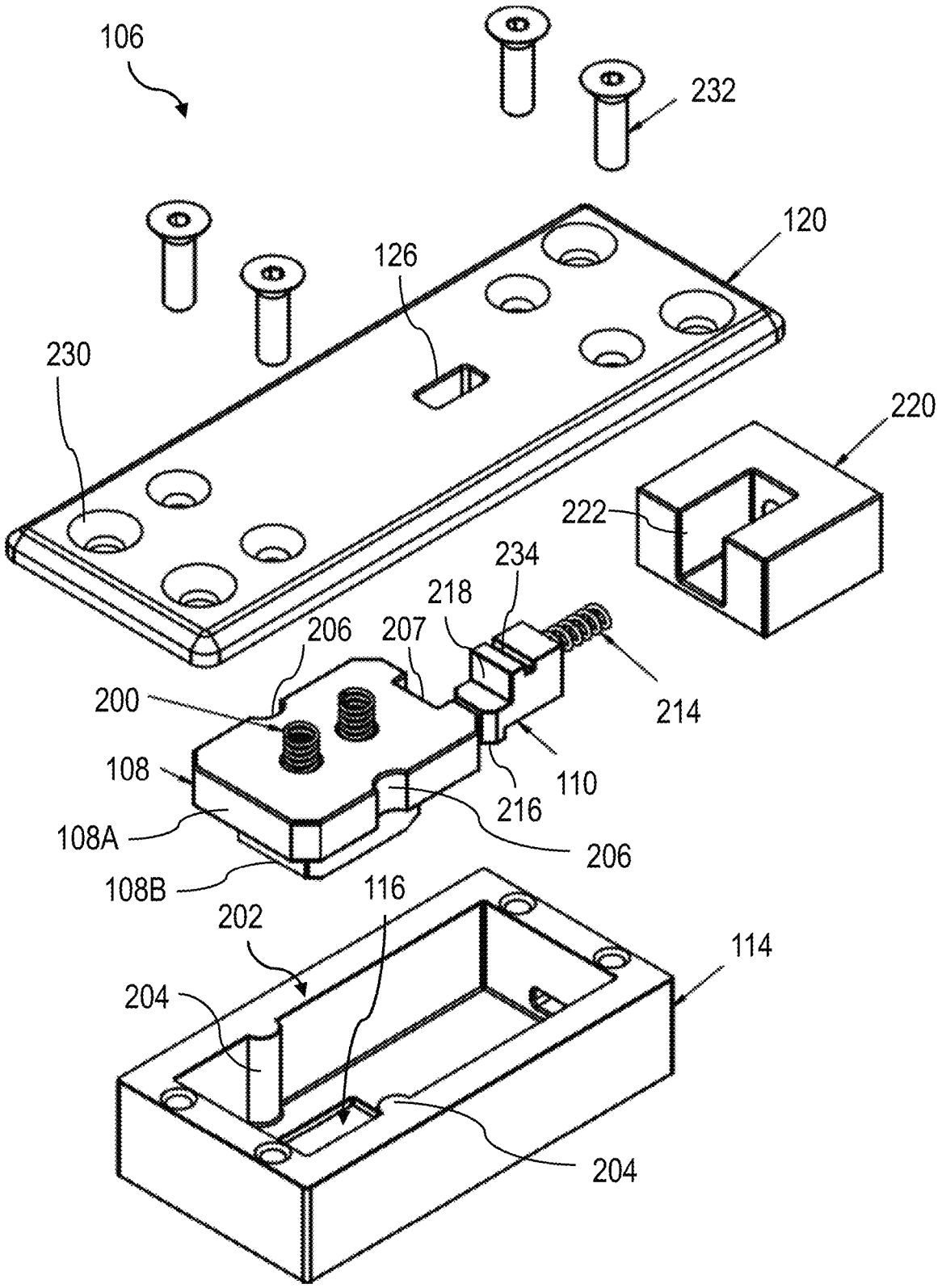
Figure 2D:
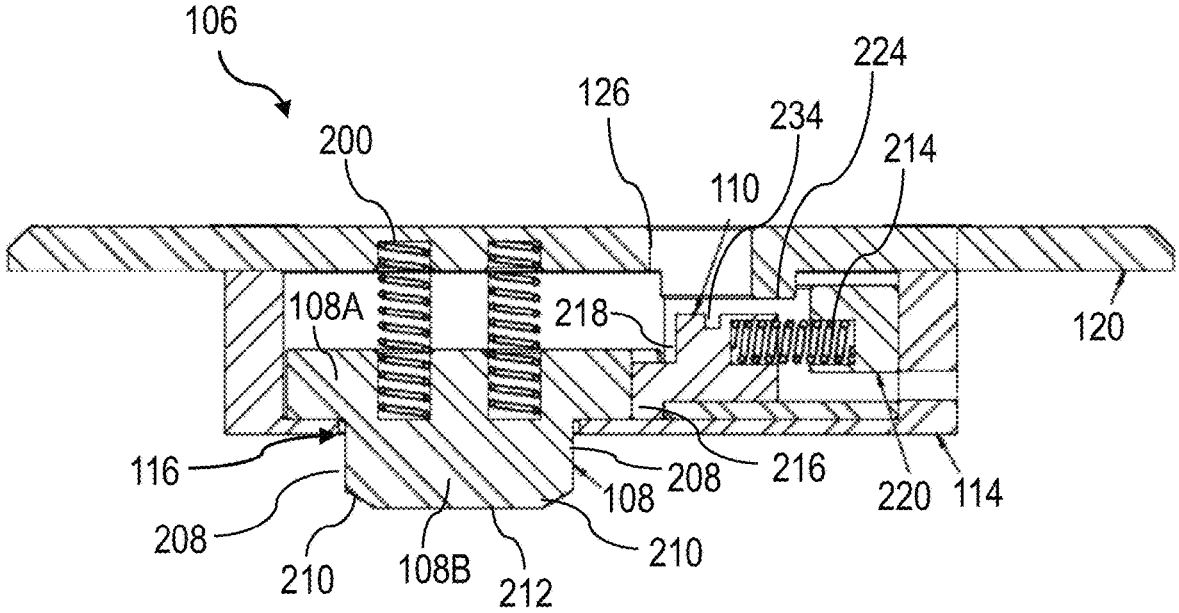
FIGS. 2D and 2E are cross-sectional views of the lug cartridge of FIGS. 2A-2C in different operational configurations, according to one or more embodiments.
Figure 2E:
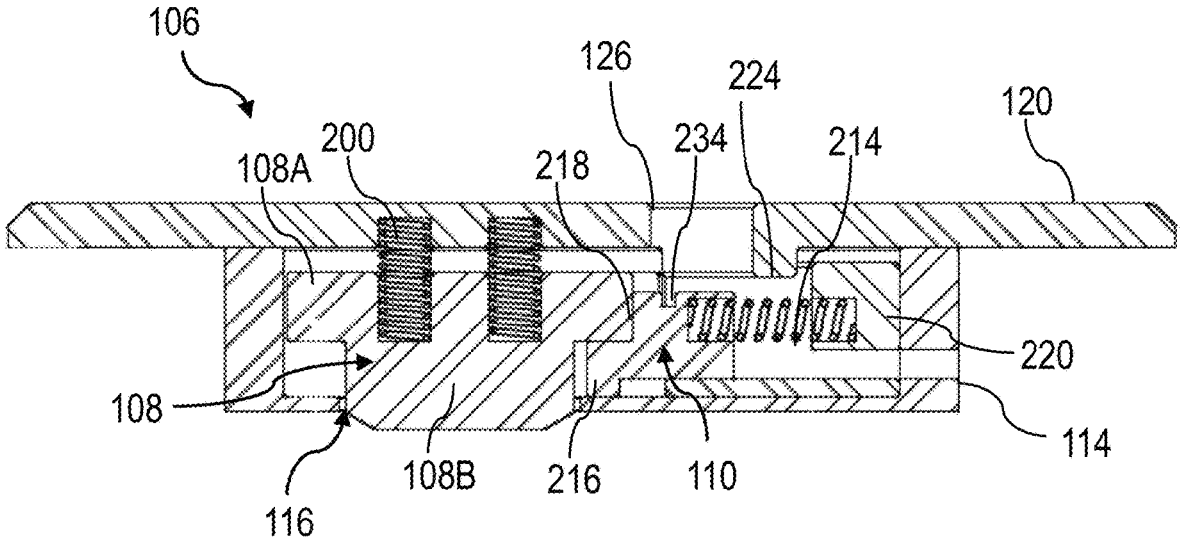

FIGS. 2A-2E illustrate a single lug cartridge 106 in more detail. The lug cartridge 106 may be a modular component that can be assembled prior to installation on the wear bushing body (e.g., 102 of FIGS. 1A and 1B), or any other equipment where lugs can be used to run but then are retracted to avoid drifting obstructions. As illustrated, the lug cartridge 106 includes the housing 114 with the opening 116 formed therein. The lug cartridge 106 also includes the spring-loaded lug 108 disposed in the housing 114. The spring-loaded lug 108 is configured to be transitioned between a first position (shown in FIG. 2D) in which the lug 108 extends outward from the opening 116 in the housing 114 and a second position (shown in FIG. 2E) in which the lug 108 is retained substantially within the housing 114. As illustrated, the spring-loaded lug 108 may be biased toward the first (extended) position (e.g., via one or more springs 200). The lug cartridge 106 also includes the retainer 110 disposed in the housing 114. As shown in FIG. 2E, the retainer 110 is configured to retain the lug 108 in the second position. The retainer 110 is configured to be automatically actuated into position to retain the spring-loaded lug 108 in response to movement of the lug 108 from the first position (FIG. 2D) to the second position (FIG. 2E). The disclosed lug cartridge 106 utilizes a spring-loaded lug 108 that, when actuated by a running tool stem, will collapse, and which will automatically be retained by the retainer 110. This exposes the bore of the wear bushing so that objects will not catch on the lugs 108.

In the illustrated embodiment, the retainer 110 is a spring-loaded retainer 110. However, other types of retainers may be used in other embodiments. The spring-loaded retainer 110 may be biased in a direction toward the spring-loaded lug 108. As shown, the spring-loaded lug 108 may be biased in a direction perpendicular to the direction in which the spring-loaded retainer 110 is biased.

As illustrated, the housing 114 may have a generally rectangular prism shape with a large opening 202 on a side opposite the opening 116 for the lug 108. The housing 114 may reduce the likelihood of rotation of the lug 108 during wear bushing setting operations. The larger opening 202 may facilitate easy construction of the lug cartridge 106. As illustrated, the housing 114 may have an elongated shape, with the spring(s) 200 biasing the spring-loaded lug 108 oriented substantially perpendicular to a long side of the housing 114 and the spring(s) 214 biasing the spring-loaded retainer 110 oriented substantially parallel to the long side of the housing 114. The housing 114 may include one or more guide features 204 (e.g., protrusions (as shown), grooves, etc.) formed therein to guide movement of the spring-loaded lug 108 in a desired direction (e.g., aligned with the springs 200). The spring-loaded lug 108 may have complementary shaped features 206 (e.g., grooves (as shown), protrusions, etc.) formed therein to move along the guide features 204 of the housing 114.

The spring-loaded lug 108 may be a solid piece of machined metal (or other material) coupled to the spring(s) 200. As shown, the spring-loaded lug 108 may include a base portion 108A and a lug portion 108B, the lug portion 108B being the part of the spring-loaded lug 108 that can be extended from the opening 116 to engage component(s) outside of the housing 114. The base portion 108A may be sized larger than the lug portion 108B (and the opening 116) so as to maintain the spring-loaded lug 108 at least partially inside the housing 114 at all times. The spring(s) 200 used to bias the lug 108 may extend partially into the base portion 108A of the lug 108. The base portion 108A may have the complementary shaped features 206 formed therein. The base portion 108A may have a cutout 207 formed therein on a side facing the retainer 110 so as to guide and/or receive the retainer 110 into engagement with the base portion 108A when the spring-loaded lug 108 is in the second position. The lug portion 108B may have generally straight walls 208 extending in a direction of movement of the lug portion 108B in and out of the housing 114. The lug portion 108B may have a chamfer 210 formed between at least one of the straight walls 208 and a furthest extending end 212 of the lug portion 108B.

The spring-loaded retainer 110 may be a solid piece of machined metal (or other material) coupled to one or more springs 214. The spring-loaded retainer 110 may include a lip 216 protruding in a direction toward the lug 108 and on a side of the retainer 110 corresponding to a side of the lug portion 108B of the lug 108. As shown in FIG. 2A, this lip 216 may directly engage a side of the base portion 108A of the lug 108 when the lug is in the extended first position. As the lug 108 is collapsed toward the second position, the spring(s) 214 bias the retainer 110 in a direction toward the lug 108 such that the lip 216 slides beneath the base portion 108A and a shoulder 218 of the retainer 110 abuts the base portion 108A. The spring force on the retainer 110 is then able to retain the shoulder 218 against the lug 108, thereby retaining the lug 108 in the retracted position. When the lug 108 is in the first position, the lip 216 of the retainer 110 may be held within the cutout 207 of the base portion 108A of the lug 108. When the lug 108 is in the second position, the shoulder 218 of the retainer 110 may be held within the cutout 207 of the base portion 108A of the lug 108.

The lug cartridge 106 may also include a retainer receiver body 220 located in the housing 114. The retainer receiver body 220 may support and guide the spring-loaded retainer 110 within the larger housing 114. As illustrated, the retainer receiver body 220 may be a solid piece of metal (or other material) sized to fit snugly within the housing 114 and having a smaller guide cutout 222 formed therein to hold the spring(s) 214 and guide movement of the spring-loaded retainer 110 toward or away from the spring-loaded lug 108. As shown in FIGS. 2D and 2E, the guide cutout 222 may also receive a complementary shaped extension 224 of the plate 120 extending into the housing 114. When the lug cartridge 106 is fully assembled and the spring-loaded lug 108 is in the first (extended) position, which may be used during run in of the wear bushing of FIGS. 1A and 1B, there is secure contact between the housing 114, the lug 108, the retainer 110, and the retainer receiver body 220. This secure connection between all the components of the lug cartridge 106 help to effectively distribute forces on the lug portion 108B through the lug cartridge 106 and into the rest of the wear bushing as needed during operations of running in and setting the wear bushing.

As discussed above, the lug cartridge 106 may have a plate 120 disposed over the housing 114 on a side of the housing 114 opposite the opening 116. The plate 120 may be coupled to the housing 114 and may include attachment features (e.g., bolt holes 230) for attaching the lug cartridge 106 to a surface (e.g., recessed surface of the wear bushing body 102 of FIG. 1A). As illustrated, the plate 120 may be coupled to the housing 114 via screws 232. The screws 232 coupling the plate 120 to the housing 114 may be oriented substantially parallel to the one or more springs 200 biasing the spring-loaded lug 108. The screws 232 may provide the ability to relieve potential energy in the lug springs 200 for safe disassembly of the lug cartridge 106.

As discussed above, the lug cartridge 106 may include a reset opening 126 that enables access to an inside of the housing 114. As shown, the reset opening 126 may be formed through the plate 120. In addition to the reset opening 126, the lug cartridge 106 may include an engagement feature 234 on the spring-loaded retainer 110. The engagement feature 234 is configured to interface with a tool received through the reset opening 126 to release the spring-loaded lug 108 from the second position back to the first position. The engagement feature 234 may include a groove (as shown), bump, detent, protrusion, ridge, textured surface, lever, or any other mechanical feature that can be engaged by a tool inserted through the reset opening 126. For example, a screw driver or similar tool may be inserted through the reset opening 126, positioned in the grooved engagement feature 234 on the retainer 110, and used to pull the retainer 110 in a direction away from the lug 108 so that the spring(s) 200 can return the lug 108 to its extended position. This allows for quick resetting of the lug cartridge 106 so that it can be run again with the wear bushing and to remove potential energy in the spring(s) 200. The design of the lug cartridge 106 enables the lug 108 to be reset quickly at the surface without remove the lug cartridge 106 from the wear bushing.

Having described the general structure of the wear bushing 100 (with reference to FIGS. 1A and 1B) and its lug cartridge(s) 106 (with reference to FIGS. 2A-2E), the processes of running, setting and selectively retrieving the wear bushing 100 will not be described. FIGS. 3A-3F illustrate a system 300 including a running tool 302 and the wear bushing 100. The wear bushing 100 is configured to be set in a well component (e.g., wellhead, casing hanger, etc.) via the running tool 302. Although the well component is not shown in the figures, the relative locations and interactions of the wear bushing 100 with respect to the well component will be described. The well component may be any desired well component having a bore that needs to be protected by a wear bushing. The wear bushing 100 of FIGS. 3A-3F may be the same or a similar wear bushing as described above with reference to FIGS. 1A-2E. FIGS. 3A-3F illustrate the process for running and setting the wear bushing 100 when the wear bushing 100 is intended to be left in the well component.

Figure 3A:
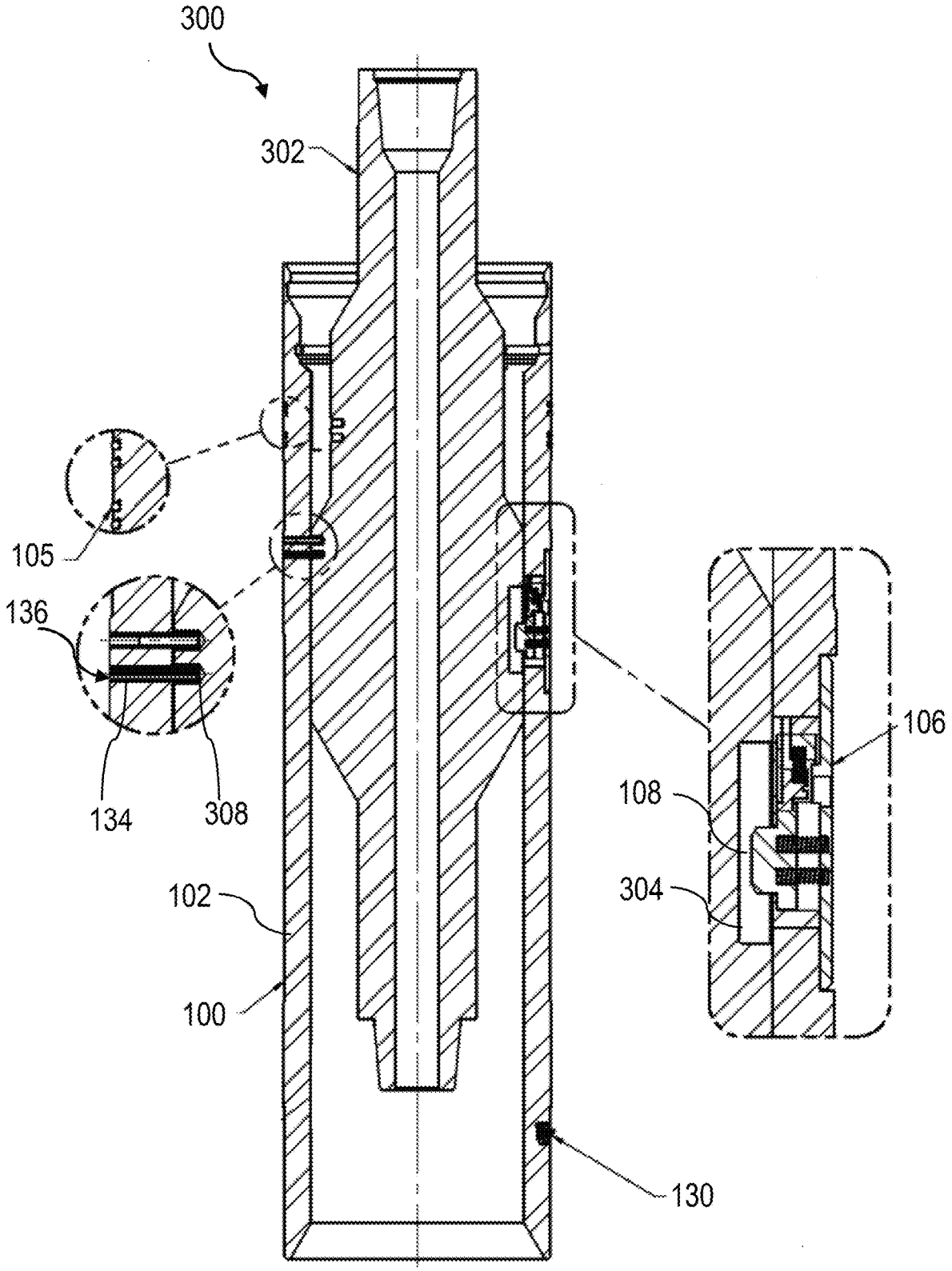
FIGS. 3A-3F are cross-sectional (3A-3C, 3E, and 3F) and partial cutaway (3D) views of a running tool installing a wear bushing, according to one or more embodiments.
Figure 3B:
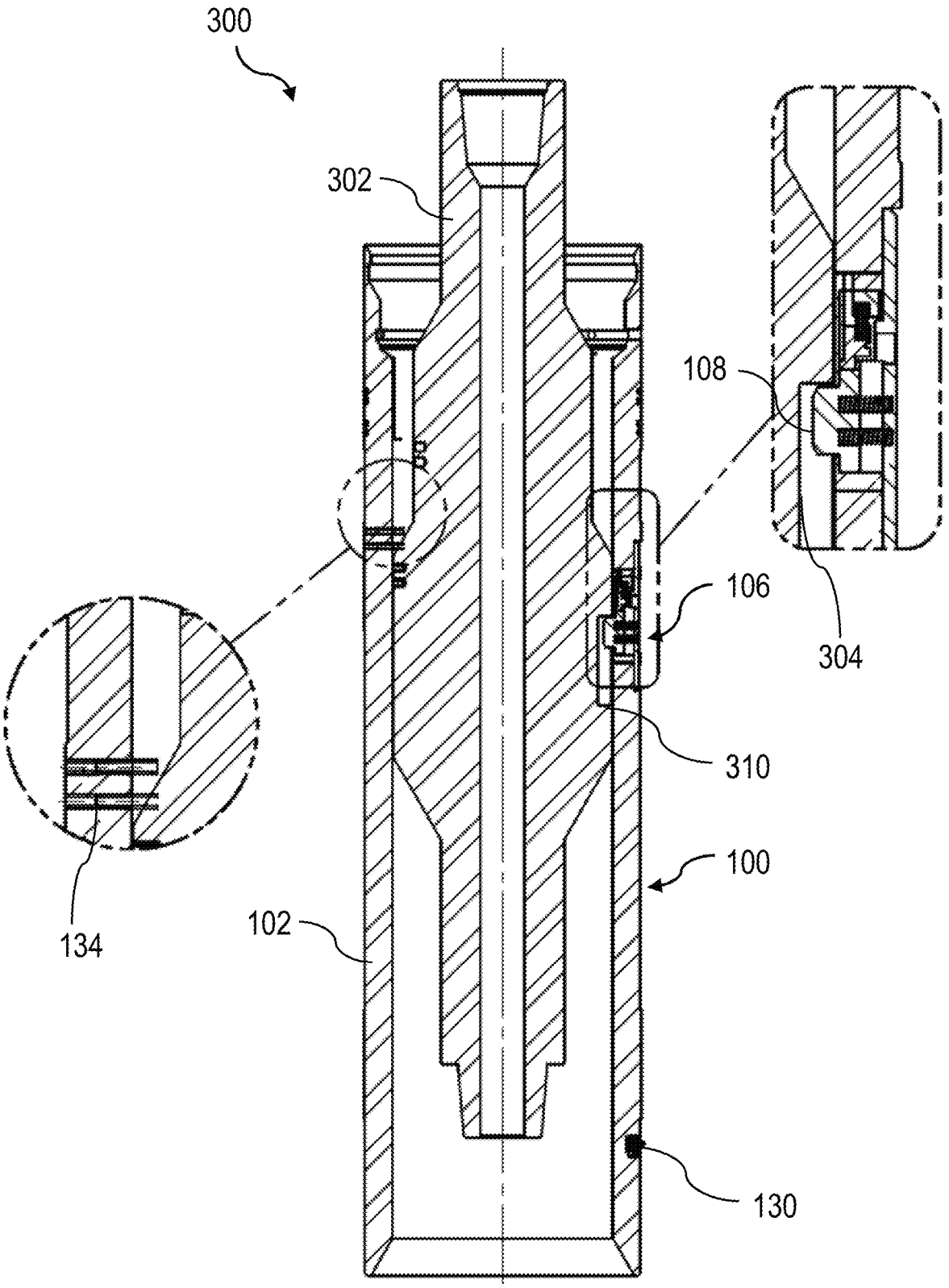
Figure 3C:
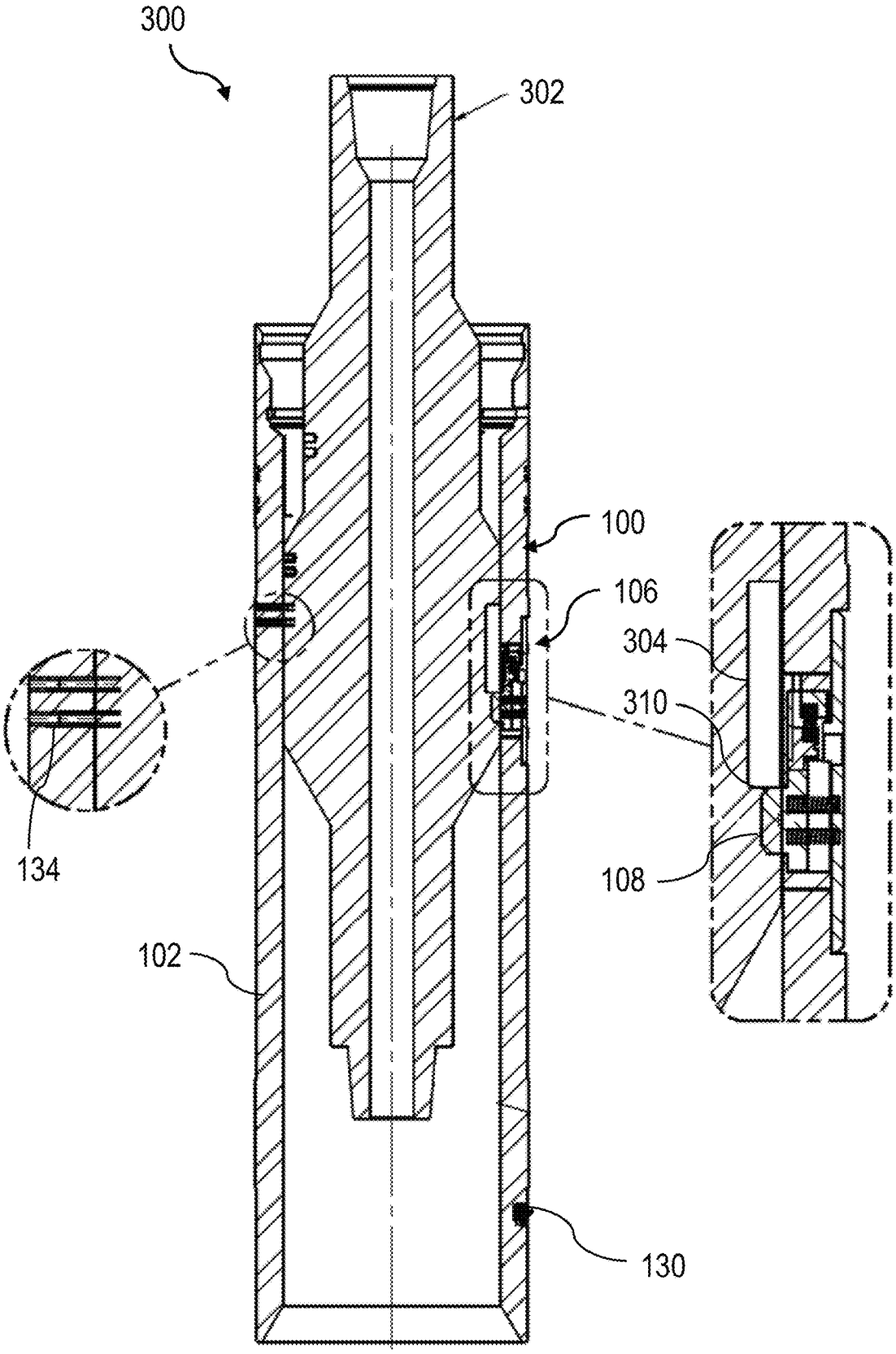
Figure 3D:
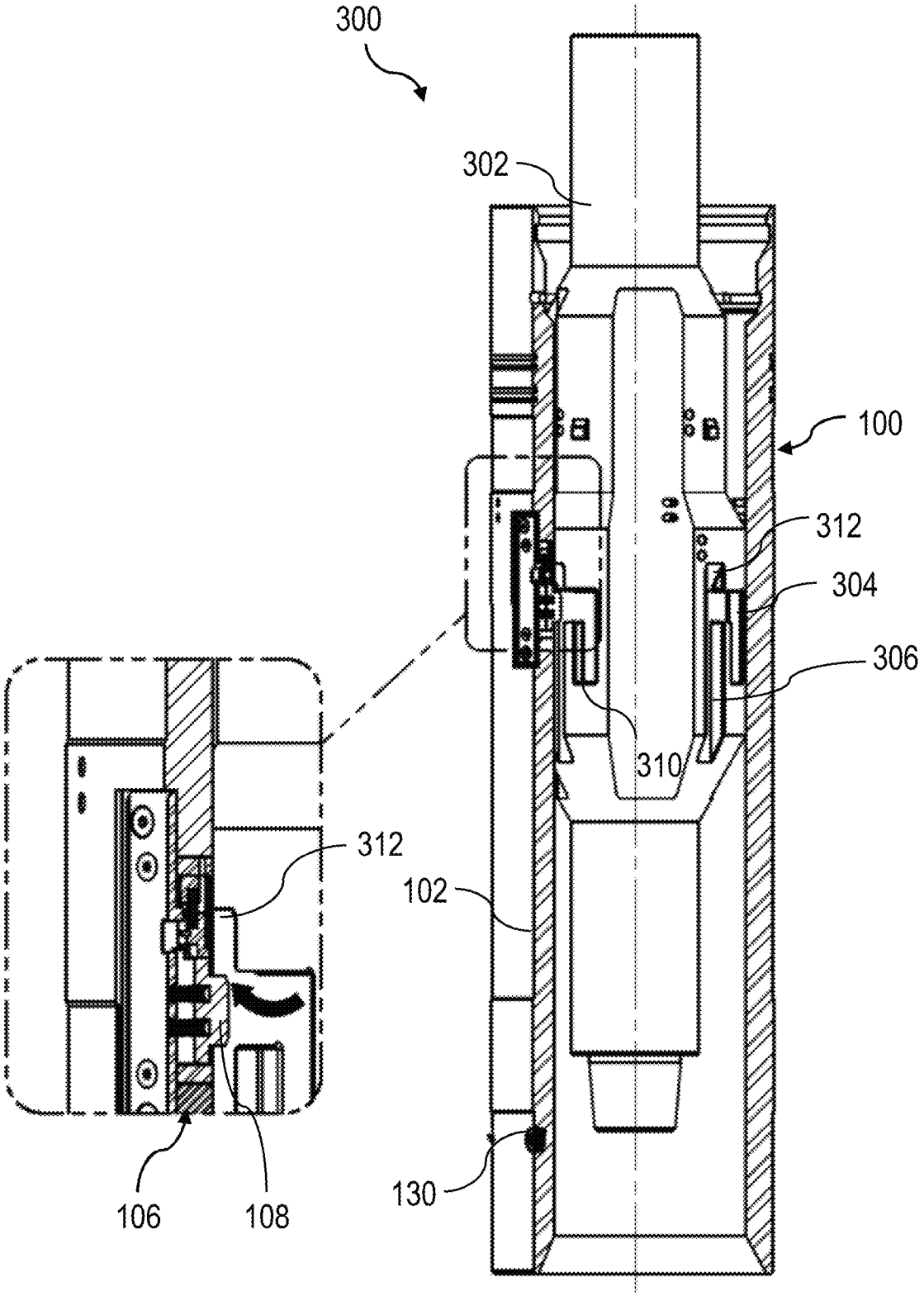

FIG. 3A illustrates the system 300 in a running configuration. The running tool 302 is installed within the wear bushing 100 such that the extended lug(s) 108 of the lug cartridge(s) 106 are located within corresponding J-slot(s) 304 on an outer surface of the running tool 302. FIG. 3D shows a more detailed view of the J-slots 304 of the running tool 302. To install the running tool 302 within the wear bushing 100 in the running configuration (of FIG. 3A), the running tool 302 may first be lowered down through the wear bushing 100 with elongated slots 306 of the running tool 302 vertically aligned with the extended lug(s) 108. Once the extended lug(s) 108 are captured in the elongated slots 306, the running tool 302 may be lowered further and then rotated to the right to move the lug(s) 108 into the J-slot(s) 304. With the lug(s) 108 in the J-slot(s) 304, the running tool 302 may then be lowered slowly until shear pin holes 308 on a radially outer surface of the running tool 302 are aligned with the shear pin holes 134 of the wear bushing 100. At this point, shear components 136 (e.g., rolled shear pins) are inserted through the aligned shear pin holes 134 and 308. The shear component(s) 136 are therefore disposed between and coupling the wear bushing 100 to the running tool 302 to secure the wear bushing 100 to the running tool 302 in the running configuration. Once installed in the running configuration of FIG. 3A, the entire system 300 may be picked up and slowly lowered downhole. As such, the process for setting the wear bushing 100 includes lowering the wear bushing toward and/or through a well component via the running tool 302.

The process for setting the wear bushing 100 may then include landing the wear bushing 100 in the well component. As the assembly lands, a shoulder on the wear bushing 100 may land out on a landing profile in the well component. Upon landing on the well component, or in order to land on the well component, the spring-loaded pins 130 may lock into corresponding recesses formed in a casing hanger or a landing shoulder within a wellhead. As such, the process may include connecting the wear bushing 100 to a radially inner portion of the well component upon landing the wear bushing 100. After landing the wear bushing 100, the process includes disengaging the running tool 302 from the wear bushing body 102. For example, upon landing the wear bushing 100 and/or connecting the wear bushing 100 to the well component, the process may include setting weight down on the running tool 302 to shear out the shear components 136 (shown in FIG. 3B), causing the running tool 302 to drop (e.g., about 2 inches) relative to the wear bushing 100.

After disengaging the running tool 302 from the wear bushing body 102, the process may include lifting the running tool 302 relative to the wear bushing 100 to apply an overpull to the wear bushing 100 via interaction between a surface 310 on the running tool 302 and the spring-loaded lug 108. This overpull step is shown in FIG. 3C. The surface 310 on the running tool may include a lower surface of the J-slot 304 in which the lug 108 is located. Applying the overpull to the wear bushing 100 allows the system to verify proper engagement of the wear bushing 100 with the well component before releasing the wear bushing entirely from the running tool 302. If a predetermined amount of overpull (e.g., 20,000 lbs) is applied by the running tool 302 and the wear bushing 100 does not move from the well component, this verifies the connection. Upon completion of the overpull, the running tool 302 may be lowered again so that the spring-loaded lug 108 is at a desired location within the J-slot 304 for rotation.

The process for setting the wear bushing 100 may then include rotating the running tool 302 (e.g., to the left) relative to the wear bushing 100 to build minor torque and move the lug 108 back into the elongated slot 306, as shown in FIG. 3D. With the lug 108 in the elongated slot 306, the spring-loaded lug 108 is in line with a ramped outer surface 312 of the running tool 302 at an upper end of the elongated slot 306. The ramped outer surface 312 is configured to interface with the spring-loaded lug 108 to move the spring-loaded lug from its first (extended) position to its second (retracted) position.

Figure 3E:
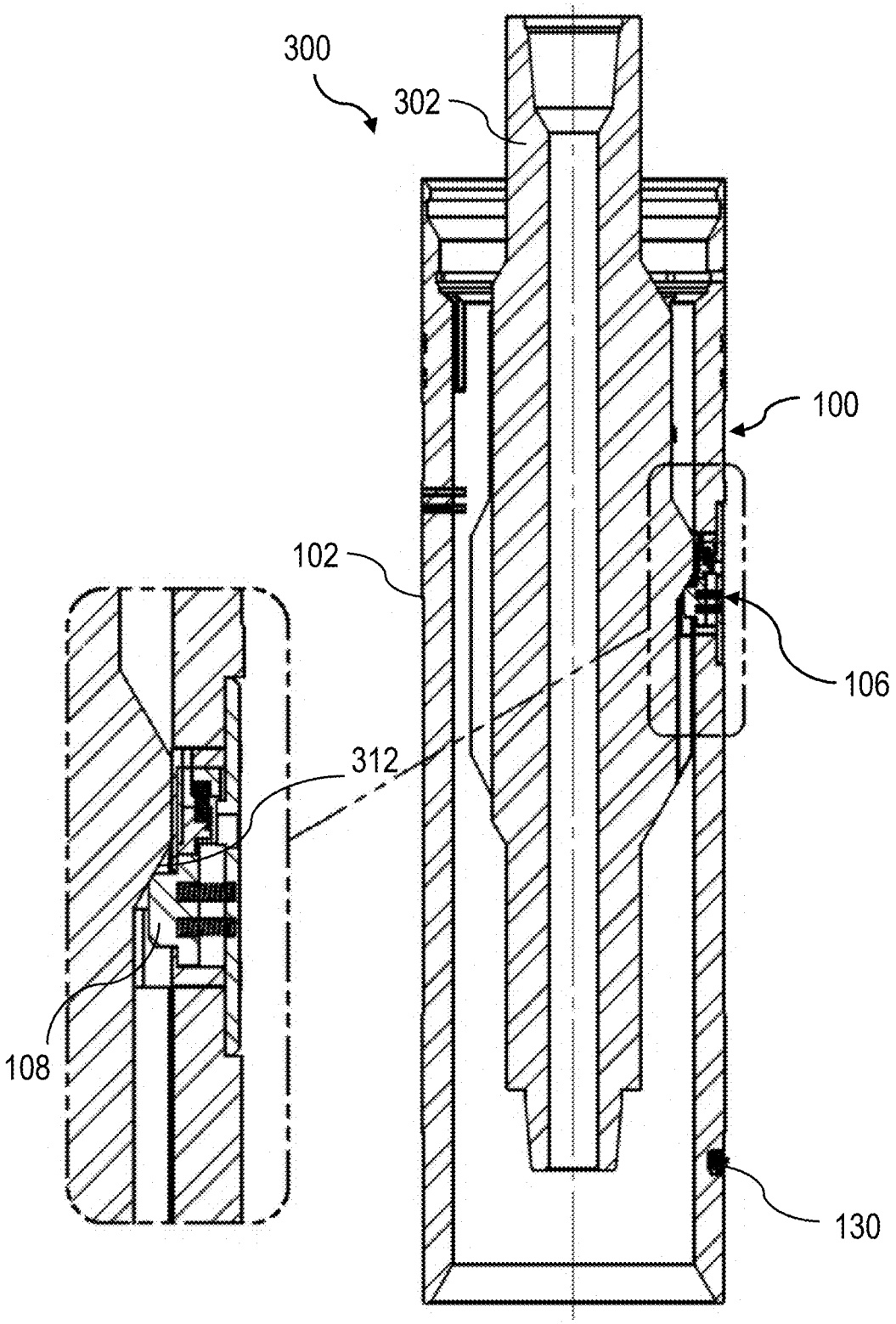

The process may then include dropping weight on the running tool 302 again to begin to collapse the lug(s) 108. Each lug 108 may be aligned with a ramped outer surface 312 at the top of the corresponding elongated slot 306. Moving the running tool 302 downward relative to the wear bushing 100, as shown in FIG. 3E, moves the ramped outer surface(s) 312 of the running tool 302 against the lug(s) 108 to collapse the spring-loaded lug(s) 108 into their retracted position in the lug cartridge(s) 106. As the lug(s) 108 are collapsed and the running tool 302 continues to move downward, this releases the running tool 302 from the wear bushing 100.

Figure 3F:
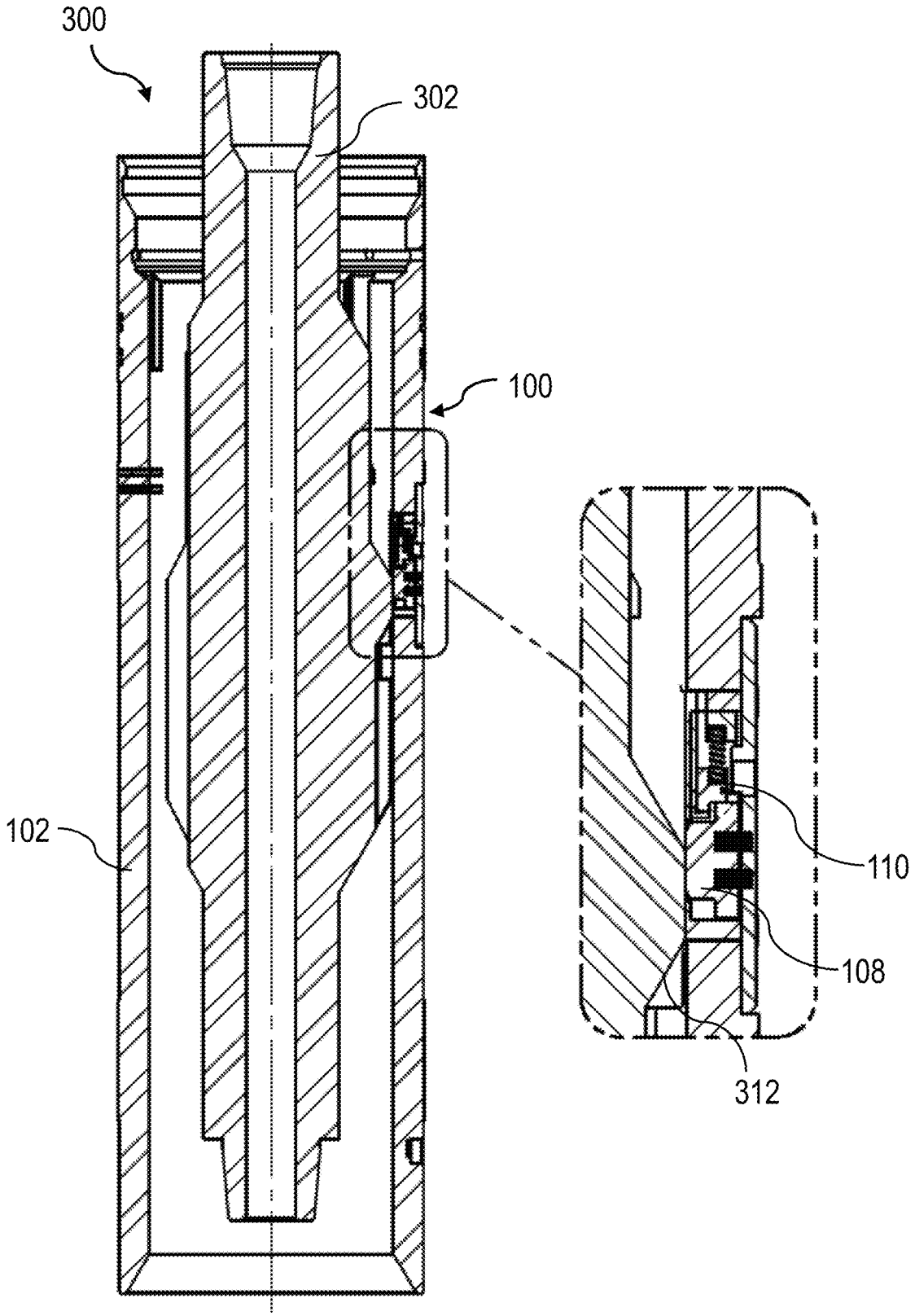

After collapsing the lug(s) 108, the process may include lowering the running tool 302 through the wear bushing 100 while the spring-loaded lug(s) 108 are retracted, as shown in FIG. 3F. The retainer(s) 110 in the lug cartridge(s) 106 may maintain the spring-loaded lug(s) 108 in the retracted position, as described above. With the lug(s) 108 retracted, a minimum inner diameter of the wear bushing 100 (including the retracted lug(s) 108) may be larger than an outer diameter of the running tool 302, thus enabling the running tool 302 to continue its descent as the drilling string on which the running tool 302 is positioned continues to drill ahead. At a later time, it may be desirable to remove the drilling string (including the running tool 302) from the well system. As such, the running tool 302 and drill string may be removed upward through the wear bushing 100 without removing the wear bushing 100 and while the spring-loaded lug(s) 108 remain retracted.

Figure 4:
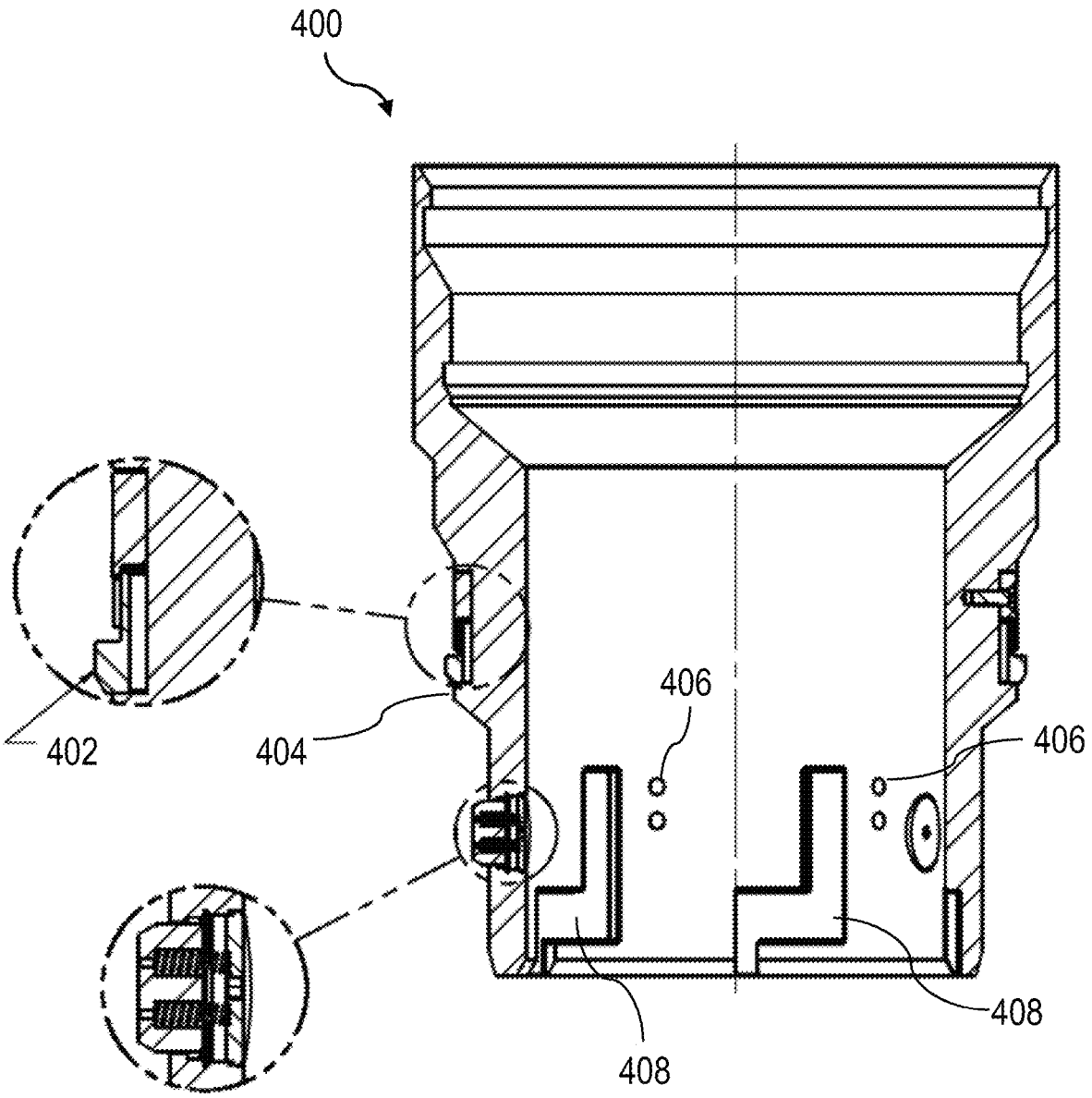
FIG. 4 is a cutaway view of a retrieval adapter for retrieving a wear bushing, according to one or more embodiments.
Figure 5:
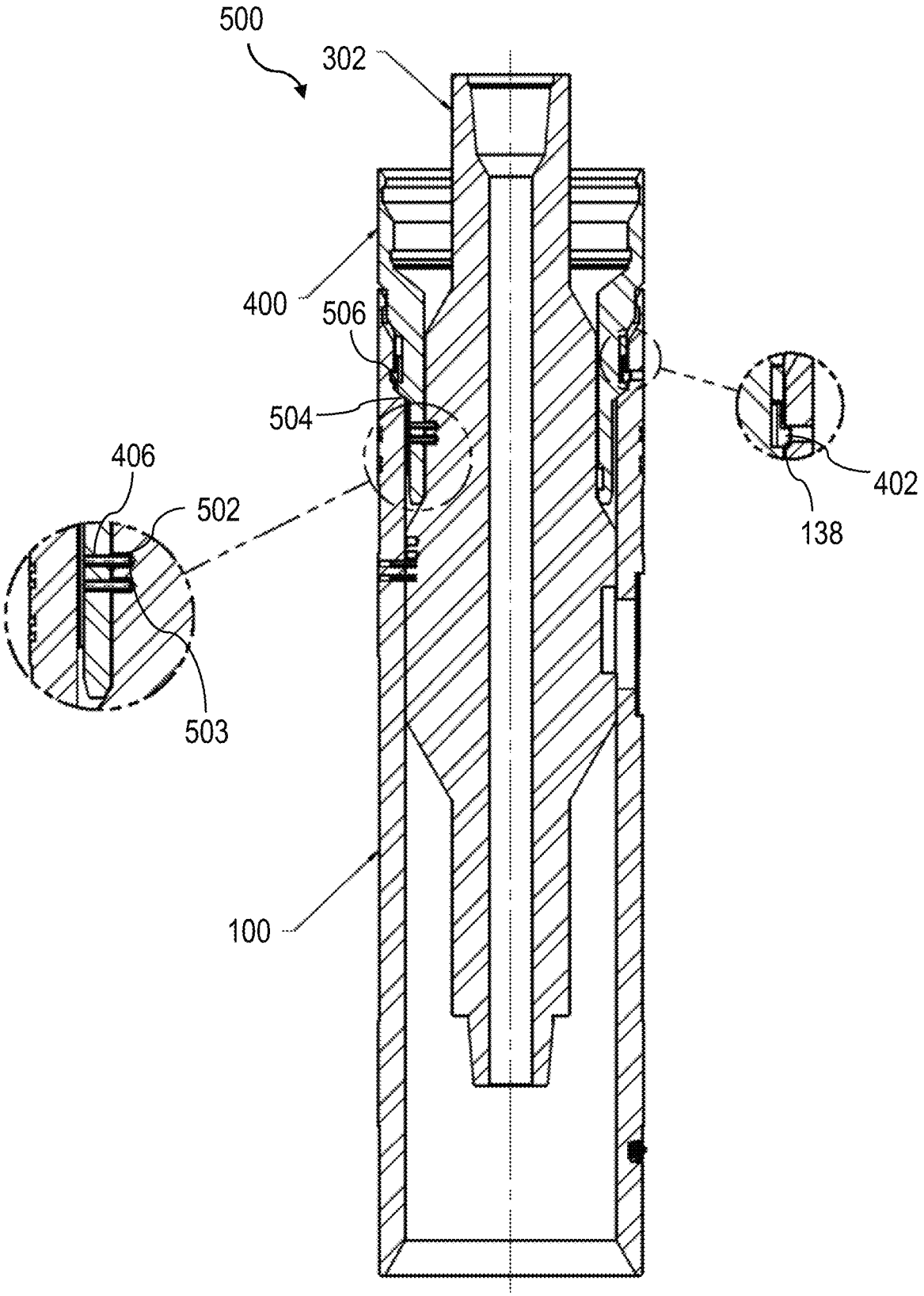
FIG. 5 is a cross-sectional view of a running tool and retrieval adapter retrieving a wear bushing, according to one or more embodiments.

FIG. 4 illustrates a wear bushing retrieval adapter 400 that may be used to retrieve the wear bushing (e.g., 100 of FIGS. 1A-3F) to the rig floor. The retrieval adapter 400 is configured to be removably coupled to a running tool (e.g., 302 of FIGS. 3A-3F) and used to selectively retrieve the wear bushing 100. The retrieval adapter 400 may be generally cylindrical and sized to be positioned around an upper portion of the running tool and to fill an annular space between the upper portion of the running tool and the wear bushing, as shown in FIG. 5. The retrieval adapter 400 may include a lock ring 402 (e.g., a split lock ring) on a radially external surface 404 thereof. The lock ring 402 is biased in a radially outward direction to be received into the groove (e.g., 138 of FIGS. 1A and 1B) of the wear bushing. The lock ring 402 is configured to directly engage the wear bushing to facilitate retrieval of the wear bushing. The retrieval adapter 400 may include shear pin holes 406 and J-slots 408 for attaching the retrieval adapter 400 to the running tool.

FIG. 5 shows a system 500 including the wear bushing 100 and the running tool 302 with the retrieval adapter 400 installed thereon. The running tool 302 and retrieval adapter 400 of FIG. 5 may be used to selectively disengage the wear bushing 100 from a well component and retrieve the wear bushing 100 to a surface location (e.g., for reuse).

First the retrieval adapter 400 may be installed on the running tool 302. This may involve engaging lugs (not shown) on the running tool 302 with the retrieval adapter J-slots (e.g., 408 of FIG. 4). In addition, multiple shear components 502 may be positioned in the shear pin holes 406 and upper shear pin holes 503 of the running tool 302 to connect the retrieval adapter 400 to the running tool 302. The running tool 302 and adapter 400 together are picked up from the connection at the top of the running tool 302 and slowly landed in the well component. As the assembly lands, a shoulder 504 on the retrieval adapter 400 will land out on a landing profile 506 of the wear bushing 100 in the well component. The lock ring 402 on the retrieval adapter 400 may then snap and engage into the groove 138 of the wear bushing 100, thereby connecting the retrieval adapter 400 to the wear bushing 100 (as shown in FIG. 5). The process may include setting weight down on the running tool 302 to shear the shear components 502 between the retrieval adapter 400 and the running tool 302. Then, rotating the running tool 302 (e.g., to the left) may release the running tool 302 from the retrieval adapter 400/wear bushing 100.

The process may include further lowering the running tool 302 through the retrieval adapter 400 and the wear bushing 100. This enables the running tool 302 to continue its descent as the drilling string on which the running tool 302 is positioned continues to drill ahead. At a later time, it may be desirable to remove the drilling string (including the running tool 302) and the wear bushing 100 from the well system. As such, the running tool 302 and drill string may be pulled straight upward through the wear bushing 100 and the retrieval adapter 400 until the running tool 302 tags the retrieval adapter 400. While applying tension in an overhead crane, the running tool 302 may be rotated (e.g., to the right) until the running tool 302 can be pulled into the J-slots (e.g., 408 of FIG. 4) of the retrieval adapter 400 and then locked to the retrieval adapter 400 once again. At this point, the running tool 302 may be carefully lifted, carrying with it the retrieval adapter 400 and the wear bushing 100, to retrieve the wear bushing 100 from the well component.

While the above description discusses using a retrieval adapter 400 to remove the wear bushing 100 from its downhole position, it should be noted that other methods may be used for removal of the wear bushing 100. For example, in some embodiments, the lug cartridge(s) 106 may be configured with a mechanism by which the lug(s) 108 can be selectively moved from their second (retracted) position back to their first (expanded) position. This may enable the running tool 302 alone (without a retrieval adapter) to be used to retrieve the wear bushing 100 to the surface. To that end, the running tool 302 may include some type of actuator used to selectively actuate the lug(s) 108 to release them from their retracted position(s) back to their expanded position(s). In embodiments where the lug(s) 108 are connected via a split ring, the actuator on the running tool 302 may be configured to interface with the split ring to move the lug(s) 108 back to their expanded positions.

With reference to all figures contained herein, in certain embodiments, the process of inserting a wear bushing 100 equipped with a lug cartridge 106 into a wellhead housing may comprise one or more of the following steps: (1) insert a running tool 302 and wear bushing 100 into a wellhead housing; (2) land the wear bushing 100 on the wellhead housing, set the weight, and apply about 20,000 to 60,000 pounds of weight, thereby moving the assembly downward roughly one to three inches; (3) pickup and apply about 20,000 pounds of tensile force via a pull in the opposite direction, and verify proper engagement to the wellhead; (4) rotate the wear bushing 100 and build torque; (5) drop the weight and begin to collapse one or more lugs 108; (6) continue to collapse the one or more lugs 108; and (7) drill ahead. Any one or more of these steps may be used alone or in combination with any other steps, including steps not explicitly recited above. Though several wear bushing configurations may be practiced with several methods of insertion without departing from the scope of the present disclosure, in certain embodiments, one or more figures presented herein may correspond to one or more steps of the process listed above. The example embodiments listed above are purely exemplary and non-limiting. Moreover, it is within the ability of one skilled in the art and with the benefit of the present disclosure to select an appropriate insertion process and appropriate corresponding wear bushing configurations.

In certain embodiments, a lug cartridge 106 as disclosed herein may be used on a casing hanger seal assembly running tool (not shown), tubing hanger running tool (not shown), lockdown sleeve running tool (not shown), seal assembly running tool (not shown), other running tool, BOP test tool (not shown), other test tool, emergency retrieval tool (not shown), other retrieval tool, cam-activated drilling ahead tool (not shown), other tool, or any combination thereof. A lug cartridge 106 may be equipped on the internal or external diameters of tools or equipment in a well. A lug cartridge 106 may be used to apply torque for adjustment, setting, and/or releasing of tools and/or equipment.

In certain embodiments, the lug cartridge 106 may be assembled as a standalone assembly that can be assembled into another assembly, such as a wear bushing 100. In certain embodiments, the modular nature and removability of the lug cartridge 106 may increase efficiency at a wellsite. In certain embodiments, damaged lugs 108 may be removed and replaced, either in the same lug cartridge 106 or a new lug cartridge 106.

Certain Illustrative Embodiments ("Embodiments") of the present disclosure are listed below.

Embodiment 1: A wear bushing, including: a wear bushing body having one or more cavities formed therein; and one or more lug cartridges each disposed within a corresponding one of the cavities in the wear bushing body, each lug cartridge including: a biased lug configured to be transitioned between a first position in which the lug protrudes in a radially inward direction from an inner diameter of the wear bushing body and a second position in which the lug is retracted into the corresponding cavity of the wear bushing body; and a retainer configured to retain the biased lug in the second position.

Embodiment 1A: The assembly of Embodiment 1, wherein the biased lug is a spring-loaded lug.

Embodiment 2: The assembly of Embodiment 1, wherein the retainer is a biased retainer.

Embodiment 2A: The assembly of Embodiment 2, wherein the biased retainer is a spring-loaded retainer.

Embodiment 3: The assembly of Embodiment 1, wherein the wear bushing body is substantially cylindrical.

Embodiment 4: The assembly of Embodiment 1, wherein each lug cartridge further includes a housing holding the biased lug and the retainer, the housing having an opening formed therein, wherein the biased lug in the first position extends outward from the opening of the housing.

Embodiment 5: The assembly of Embodiment 1, wherein: each lug cartridge further includes a reset opening therein that enables access to an inside of the lug cartridge; and the retainer of each lug cartridge has an engagement feature configured to interface with a tool received through the reset opening to release the biased lug from the second position back to the first position.

Embodiment 6: The assembly of Embodiment 5, wherein the reset opening is accessible from outside an outer circumferential surface of the wear bushing body.

Embodiment 7: The assembly of Embodiment 1, further including one or more biased pins disposed along an outer circumferential surface of the wear bushing body.

Embodiment 7A: The assembly of Embodiment 7, wherein the one or more biased pins are one or more spring-loaded pins.

Embodiment 8: The assembly of Embodiment 1, wherein the wear bushing body includes a groove formed along an inner circumferential surface thereof.

Embodiment 9: The assembly of Embodiment 1, wherein the wear bushing body includes one or more shear pin holes formed therethrough.

Embodiment 10: The assembly of Embodiment 1, wherein the one or more lug cartridges include a plurality of lug cartridges disposed in cavities located substantially equidistant from each other about a circumference of the wear bushing body.

Embodiment 11: The assembly of Embodiment 1, wherein each lug cartridge has an elongated shape, and wherein each lug cartridge is positioned such that a long side of the lug cartridge is substantially parallel to a longitudinal axis of the wear bushing body.

Embodiment 11A: The assembly of Embodiment 1, wherein each lug cartridge is removable from the wear bushing body and replaceable with another lug cartridge.

Embodiment 12: A lug cartridge, including: a housing with an opening formed therein; a biased lug disposed in the housing and configured to be transitioned between a first position in which the lug extends outward from the opening in the housing and a second position in which the lug is retained substantially within the housing, the biased lug being biased toward the first position; and a biased retainer disposed in the housing and configured to retain the lug in the second position, wherein the retainer is biased in a direction toward the biased lug.

Embodiment 13: The lug cartridge of Embodiment 12, wherein the retainer is configured to be automatically actuated into position to retain the biased lug in response to movement of the lug from the first position to the second position.

Embodiment 14: The lug cartridge of Embodiment 12, wherein the biased lug is biased in a direction perpendicular to a direction in which the biased retainer is biased.

Embodiment 15: The lug cartridge of Embodiment 12, further including: a reset opening that enables access to an inside of the housing; and an engagement feature on the biased retainer configured to interface with a tool received through the reset opening to release the biased lug from the second position back to the first position.

Embodiment 16: The lug cartridge of Embodiment 12, further including a plate disposed over the housing on a side of the housing opposite the opening, the plate being coupled to the housing, wherein the plate includes attachment features for attaching the lug cartridge assembly to a surface.

Embodiment 17: The lug cartridge of Embodiment 16, further including screws coupling the plate to the housing, the screws being oriented substantially parallel to one or more springs biasing the biased lug.

Embodiment 18: The lug cartridge of Embodiment 12, wherein: the housing has an elongated shape, one or more springs biasing the biased lug are oriented substantially perpendicular to a long side of the housing, and one or more springs biasing the biased retainer are oriented substantially parallel to the long side of the housing.

Embodiment 19: A system, including: a running tool; and a wear bushing configured to be positioned and set in a well component via the running tool, wherein the wear bushing includes: a wear bushing body having one or more cavities formed therein; and one or more lug cartridges each disposed within a corresponding one of the cavities in the wear bushing body, each lug cartridge including: a biased lug configured to be transitioned between a first position in which the lug protrudes in a radially inward direction from an inner diameter of the wear bushing body and a second position in which the lug is retracted into the corresponding cavity of the wear bushing body; and a retainer configured to retain the biased lug in the second position.

Embodiment 20: The system of Embodiment 19, wherein the running tool includes a ramped outer surface configured to interface with the biased lug to move the biased lug from the first position to the second position.

Embodiment 21: The system of Embodiment 19, further including one or more shear components disposed between and coupling the wear bushing to the running tool.

Embodiment 22: The system of Embodiment 19, wherein an inner diameter of the wear bushing with the one or more biased lugs in the second position is larger than an outer circumferential surface of the running tool.

Embodiment 23: The system of Embodiment 19, further including a retrieval adapter configured to be removably coupled to the running tool and used to selectively retrieve the wear bushing.

Embodiment 24: The system of Embodiment 23, wherein the retrieval adapter is configured to be coupled to the running tool via one or more shear components.

Embodiment 25: The system of Embodiment 23, wherein the retrieval adapter includes a lock ring biased in a radially outward direction, and the wear bushing body includes a groove formed in its inner circumferential surface to receive the lock ring.

Embodiment 25A: The system of Embodiment 19, wherein each lug cartridge is configured to be selectively actuated to transition the biased lug from the second position back to the first position while the wear bushing is disposed in the well component.

Embodiment 26: A method, including: lowering, via a running tool, a wear bushing and landing the wear bushing in a well component, the wear bushing including: a cylindrical body having a cavity formed therein; and a lug cartridge disposed within the cavity, the lug cartridge having a biased lug and a retainer; disengaging the running tool from the body of the wear bushing; collapsing the biased lug into a retracted position within the lug cartridge via movement of a ramped outer surface of the running tool against the lug; and maintaining the biased lug in the retracted position via the retainer.

Embodiment 27: The method of Embodiment 26, further including connecting the wear bushing to a radially inner portion of the well component upon landing the wear bushing.

Embodiment 28: The method of Embodiment 27, further including, after disengaging the running tool from the body of the wear bushing: lifting the running tool relative to the wear bushing to apply an overpull to the wear bushing via interaction between a surface on the running tool and the biased lug; and rotating the running tool relative to the wear bushing to move the ramped outer surface in line with the biased lug.

Embodiment 29: The method of Embodiment 26, further including lowering the running tool through the wear bushing while the biased lug is retracted.

Embodiment 30: The method of Embodiment 26, further including coupling a retrieval adapter to the running tool and retrieving the wear bushing from the well component via the retrieval adapter.

Embodiment 31: The method of Embodiment 30, further including expanding a lock ring on the retrieval adapter in a radially outward direction into a groove formed along an inner circumferential surface of the wear bushing body to couple the wear bushing to the retrieval adapter.

Embodiment 32: The method of Embodiment 26, further including retrieving the wear bushing to a surface location, and resetting the biased lug from the second position to the first position without removing the lug cartridge from the wear bushing body.

Embodiments illustrated under any heading or in any portion of the disclosure may be combined with embodiments illustrated under the same or any other heading or other portion of the disclosure unless otherwise indicated herein or otherwise clearly contradicted by context.

Numerous modifications, alterations, and changes to the described embodiments are possible without departing from the scope of the present invention defined in the claims. It is intended that the present invention not be limited to the described embodiments, but that it has the full scope defined by the language of the following claims, and equivalents thereof.

While various embodiments of wear bushings, lug cartridges, systems, and methods were provided in the foregoing description, those skilled in the art may make modifications and alterations to these aspects without departing from the scope and spirit of the invention. For example, it is to be understood that this disclosure contemplates that, to the extent possible, one or more features of any aspect can be combined with one or more features of any other aspect. Accordingly, the foregoing description is intended to be illustrative rather than restrictive. The invention described hereinabove is defined by the appended claims, and all changes to the invention that fall within the meaning and the range of equivalency of the claims are to be embraced within their scope.

What is claimed is:

1. A wear bushing, comprising:

a wear bushing body having one or more cavities formed therein; and one or more lug cartridges each disposed within a corresponding one of the one or more cavities in the wear bushing body, each lug cartridge comprising:

a housing with an opening formed therein;

a biased lug configured to be transitioned between a first position in which the lug protrudes in a radially inward direction from an inner diameter of the wear bushing body and a second position in which the lug is retracted into the corresponding cavity of the wear bushing body;

a retainer configured to retain the biased lug in the second position; and a plate disposed over the housing on a side of the housing opposite the opening, the plate being coupled to the housing, wherein the plate comprises attachment features for attaching each lug cartridge to a surface.

2. The wear bushing of claim 1, wherein the retainer is a biased retainer.

3. The wear bushing of claim 1, wherein the housing is configured to hold the biased lug and the retainer, wherein the biased lug in the first position extends outward from the opening of the housing.

4. The wear bushing of claim 1, wherein:

each lug cartridge further comprises a reset opening therein that enables access to an inside of each lug cartridge; and the retainer of each lug cartridge has an engagement feature configured to interface with a tool received through the reset opening to release the biased lug from the second position back to the first position.

5. The wear bushing of claim 4, wherein the reset opening is accessible from outside an outer circumferential surface of the wear bushing body.

6. The wear bushing of claim 1, wherein the wear bushing body comprises a groove formed along an inner circumferential surface thereof.

7. The wear bushing of claim 1, wherein the wear bushing body comprises one or more shear pin holes formed therethrough.

8. The wear bushing of claim 1, wherein the one or more lug cartridges comprise a plurality of lug cartridges disposed in cavities located substantially equidistant from each other about a circumference of the wear bushing body.

9. A lug cartridge, comprising:

a housing with an opening formed therein;

a biased lug disposed in the housing and configured to be transitioned between a first position in which the lug extends outward from the opening in the housing and a second position in which the lug is retained substantially within the housing, the biased lug being biased toward the first position;

a biased retainer disposed in the housing and configured to retain the lug in the second position, wherein the retainer is biased in a direction toward the biased lug; and a plate disposed over the housing on a side of the housing opposite the opening, the plate being coupled to the housing, wherein the plate comprises attachment features for attaching the lug cartridge to a surface.

10. The lug cartridge of claim 9, wherein the retainer is configured to be automatically actuated into position to retain the biased lug in response to movement of the lug from the first position to the second position.

11. The lug cartridge of claim 9, wherein the biased lug is biased in a direction perpendicular to a direction in which the biased retainer is biased.

12. The lug cartridge of claim 9, further comprising:

a reset opening that enables access to an inside of the housing; and an engagement feature on the biased retainer configured to interface with a tool received through the reset opening to release the biased lug from the second position back to the first position.

13. The lug cartridge of claim 9, further comprising screws coupling the plate to the housing, the screws being oriented substantially parallel to one or more springs biasing the biased lug.

14. The lug cartridge of claim 9, wherein:

the housing has an elongated shape, one or more springs biasing the biased lug are oriented substantially perpendicular to a long side of the housing, and one or more springs biasing the biased retainer are oriented substantially parallel to the long side of the housing.

15. A system, comprising:

a running tool; and a wear bushing configured to be positioned and set in a well component via the running tool, wherein the wear bushing comprises:

a wear bushing body having one or more cavities formed therein; and one or more lug cartridges each disposed within a corresponding one of the one or more cavities in the wear bushing body, each lug cartridge comprising:

a housing with an opening formed therein;

a biased lug configured to be transitioned between a first position in which the lug protrudes in a radially inward direction from an inner diameter of the wear bushing body and a second position in which the lug is retracted into the corresponding cavity of the wear bushing body;

a retainer configured to retain the biased lug in the second position; and a plate disposed over the housing on a side of the housing opposite the opening, the plate being coupled to the housing, wherein the plate comprises attachment features for attaching each lug cartridge to a surface.

16. The system of claim 15, wherein the running tool comprises a ramped outer surface configured to interface with the biased lug to move the biased lug from the first position to the second position.

17. The system of claim 15, wherein an inner diameter of the wear bushing with the one or more lug cartridges having biased lugs in the second position is larger than an outer circumferential surface of the running tool.

18. The system of claim 15, further comprising a retrieval adapter configured to be removably coupled to the running tool and used to selectively retrieve the wear bushing.

19. The system of claim 18, wherein the retrieval adapter comprises a lock ring biased in a radially outward direction, and the wear bushing body comprises a groove formed in its inner circumferential surface to receive the lock ring.

20. A method, comprising:

lowering, via a running tool, a wear bushing and landing the wear bushing in a well component, the wear bushing comprising:

a cylindrical body having a cavity formed therein; and a lug cartridge disposed within the cavity, the lug cartridge having a biased lug, a housing with an opening formed therein, and a retainer;

disengaging the running tool from the cylindrical body of the wear bushing;

attaching the lug cartridge to a surface of the cylindrical body by attachment features of a plate coupled to the housing and disposed over the housing on a side of the housing opposite the opening;

collapsing the biased lug into a retracted position within the lug cartridge via movement of a ramped outer surface of the running tool against the lug; and maintaining the biased lug in the retracted position via the retainer.

21. The method of claim 20, further comprising connecting the wear bushing to a radially inner portion of the well component upon landing the wear bushing.

22. The method of claim 21, further comprising, after disengaging the running tool from the cylindrical body of the wear bushing:

lifting the running tool relative to the wear bushing to apply an overpull to the wear bushing via interaction between a surface on the running tool and the biased lug; and rotating the running tool relative to the wear bushing to move the ramped outer surface in line with the biased lug.

23. The method of claim 20, further comprising lowering the running tool through the wear bushing while the biased lug is retracted.

24. The method of claim 20, further comprising coupling a retrieval adapter to the running tool and retrieving the wear bushing from the well component via the retrieval adapter.

25. The method of claim 24, further comprising expanding a lock ring on the retrieval adapter in a radially outward direction into a groove formed along an inner circumferential surface of the cylindrical body of the wear bushing to couple the wear bushing to the retrieval adapter.

26. The method of claim 20, further comprising retrieving the wear bushing to a surface location, and resetting the biased lug from a second position being the retracted position to a first position in which the lug protrudes in a radially inward direction from an inner diameter of the cylindrical body without removing the lug cartridge from the cylindrical body.

* * * * *